US008439229B2

(12) United States Patent
Alluigi

(10) Patent No.: US 8,439,229 B2
(45) Date of Patent: May 14, 2013

(54) CLOSURE SYSTEM BETWEEN A DISPENSER HEAD AND CONTAINER OF A DEVICE FOR DISPENSING

(75) Inventor: Riccardo Alluigi, Alessandria (IT)

(73) Assignee: Guala Dispensing S.p.A., Alessandria (IT)

( * ) Notice: Subject to any disclaimer, the term of this patent is extended or adjusted under 35 U.S.C. 154(b) by 133 days.

(21) Appl. No.: 13/130,604

(22) PCT Filed: Jun. 5, 2009

(86) PCT No.: PCT/IB2009/052381

§ 371 (c)(1), (2), (4) Date: May 23, 2011

(87) PCT Pub. No.: WO2010/061295

PCT Pub. Date: Jun. 3, 2010

(65) Prior Publication Data

US 2011/0226816 A1 Sep. 22, 2011

(30) Foreign Application Priority Data

Nov. 25, 2008 (EP) ..... 08425753

(51) Int. Cl.
*B67B 1/00* (2006.01)
*B67D 7/58* (2010.01)
*B65D 55/02* (2006.01)

(52) U.S. Cl.
USPC ..... 222/153.09; 222/153.1; 222/383.1; 215/218; 215/219; 220/259.4

(58) Field of Classification Search ..... 222/153.09, 222/153.1, 383.1; 220/259.3, 259.4; 215/217, 215/218, 219
See application file for complete search history.

(56) References Cited

U.S. PATENT DOCUMENTS

| | | | | |
|---|---|---|---|---|
| 3,901,400 | A * | 8/1975 | Westfall | 215/221 |
| 3,905,509 | A | 9/1975 | Markowitz | |
| 4,345,691 | A * | 8/1982 | Burke | 215/216 |
| 4,366,921 | A * | 1/1983 | Kirk, Jr. | 222/153.09 |
| 4,454,965 | A * | 6/1984 | Kirk, Jr. | 222/153.09 |
| 5,238,152 | A * | 8/1993 | Maas et al. | 222/153.09 |
| 5,791,504 | A | 8/1998 | Hofmann et al. | |
| 6,814,259 | B1 * | 11/2004 | Foster et al. | 222/153.09 |
| 8,201,710 | B2 * | 6/2012 | Helf et al. | 222/153.09 |
| 2004/0206779 | A1 | 10/2004 | Foster et al. | |
| 2006/0278642 | A1 * | 12/2006 | Pugne et al. | 220/256.1 |

FOREIGN PATENT DOCUMENTS

GB 2213476 A * 5/1988

* cited by examiner

*Primary Examiner* — Kevin P Shaver
*Assistant Examiner* — Nicholas J Weiss
(74) *Attorney, Agent, or Firm* — Shoemaker and Mattare

(57) ABSTRACT

A closure for a liquid container is provided between the container and a liquid dispenser head. The closure includes an intermediate body between the dispenser head and the container. The dispenser head can be rotated with respect to the container, without unscrewing the closure, except when the intermediate body is manually prevented from rotating.

11 Claims, 8 Drawing Sheets

CLOSURE SYSTEM BETWEEN A DISPENSER HEAD AND CONTAINER OF A DEVICE FOR DISPENSING

BACKGROUND OF THE INVENTION

The present invention relates to a closure system between a dispenser head and container of a device for dispensing liquid.

Specifically, the present invention relates to the field of CRC (Child Resistant Container) closure systems, able to prevent opening of the container by a child.

In such field international legislation sets out that a CRC closure system must require a dual movement to obtain opening.

For example, a closure system having a dispenser head screwed into the neck of the container is not a CRC system. In fact, to open such a system it is sufficient to hold the container and turn the dispenser head to unscrew it from the neck.

For example, the closure system described in the patent U.S. Pat. No. 5,147,074, in the name of the Applicant, is not a CRC system.

Most of the CRC closure systems known today provide for a dispenser head which turns idly on the container, so that even holding the container still, the closure body, although rotated, does not separate from the container. To achieve separation in such systems a dual action of squeezing and rotation of the dispenser head must be exerted contemporarily.

One embodiment of such a system is described in document U.S. pat. No. 4,346,821.

However, one of the needs of the field is to provide for CRC closure systems which, when required, allow separation of the dispenser head from the container, for example so as to fill up the container or to fit the dispenser head to another container.

The CRC closure systems known of today do not satisfy such requirement, except by engaging the consumer with undue burden in separating the dispenser head from the container.

In addition, closure systems are known of in which the dispenser head is applied under pressure to the container, to the filler lines of the liquid. Such systems do not require screwing up.

SUMMARY OF THE INVENTION

The purpose of the present invention is to provide for a CRC closure system which overcomes the drawbacks of the known art and meets the aforesaid requirements.

A further purpose of the present invention is to create a CRC closure system for such devices too.

Such purpose is achieved by a closure system as described below.

DESCRIPTION OF THE DRAWINGS

The characteristics and advantages of the closure system according to the present invention will be evident from the description below, made by way of an indicative and non-limiting example, with reference to the attached figures, wherein.

DESCRIPTION OF THE PREFERRED EMBODIMENTS

Figure 1:
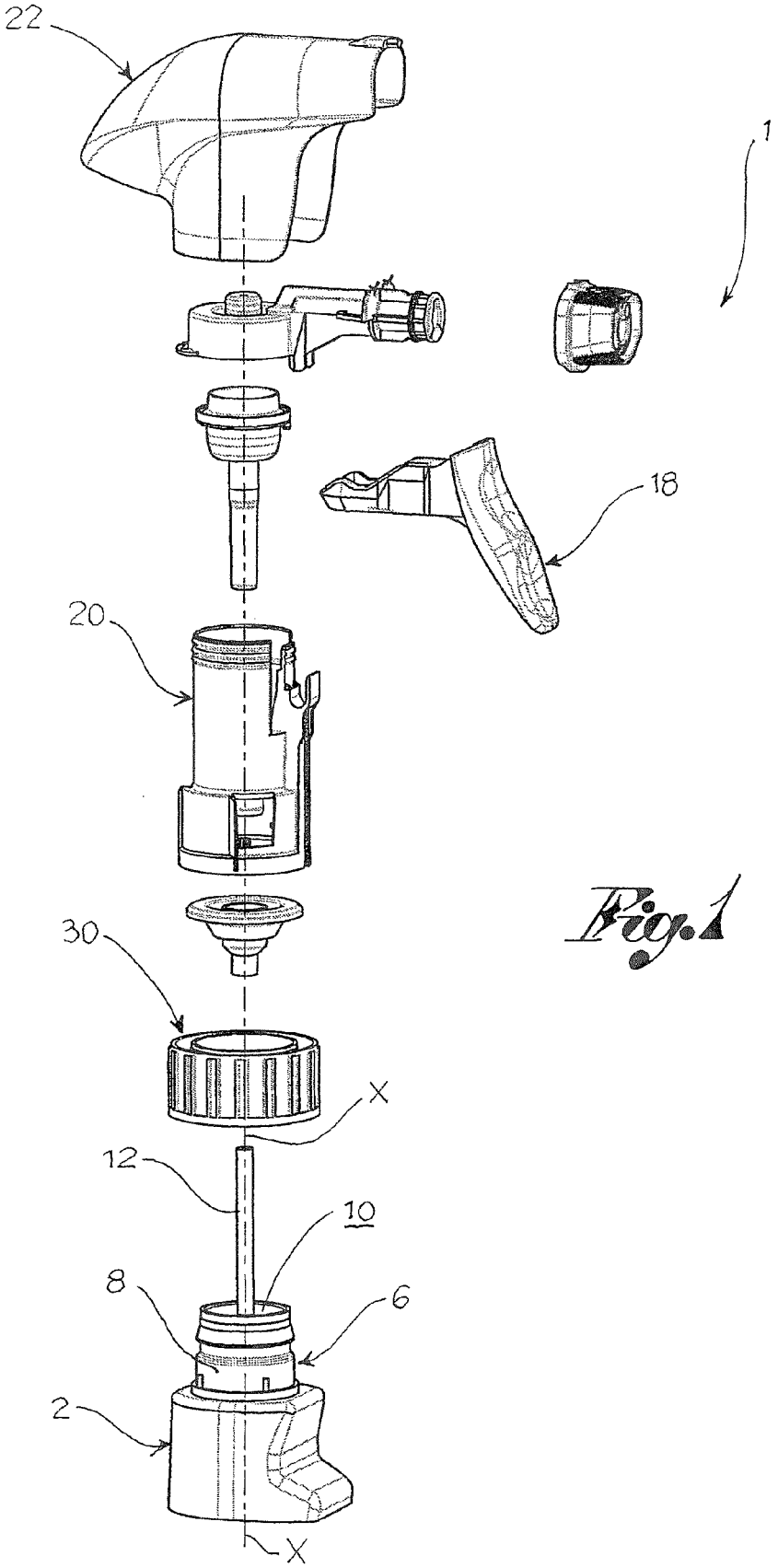
FIG. 1 shows a perspective view in separate parts of a dispenser device of a liquid, containing a closure system according to an embodiment of the present invention.
Figure 2:
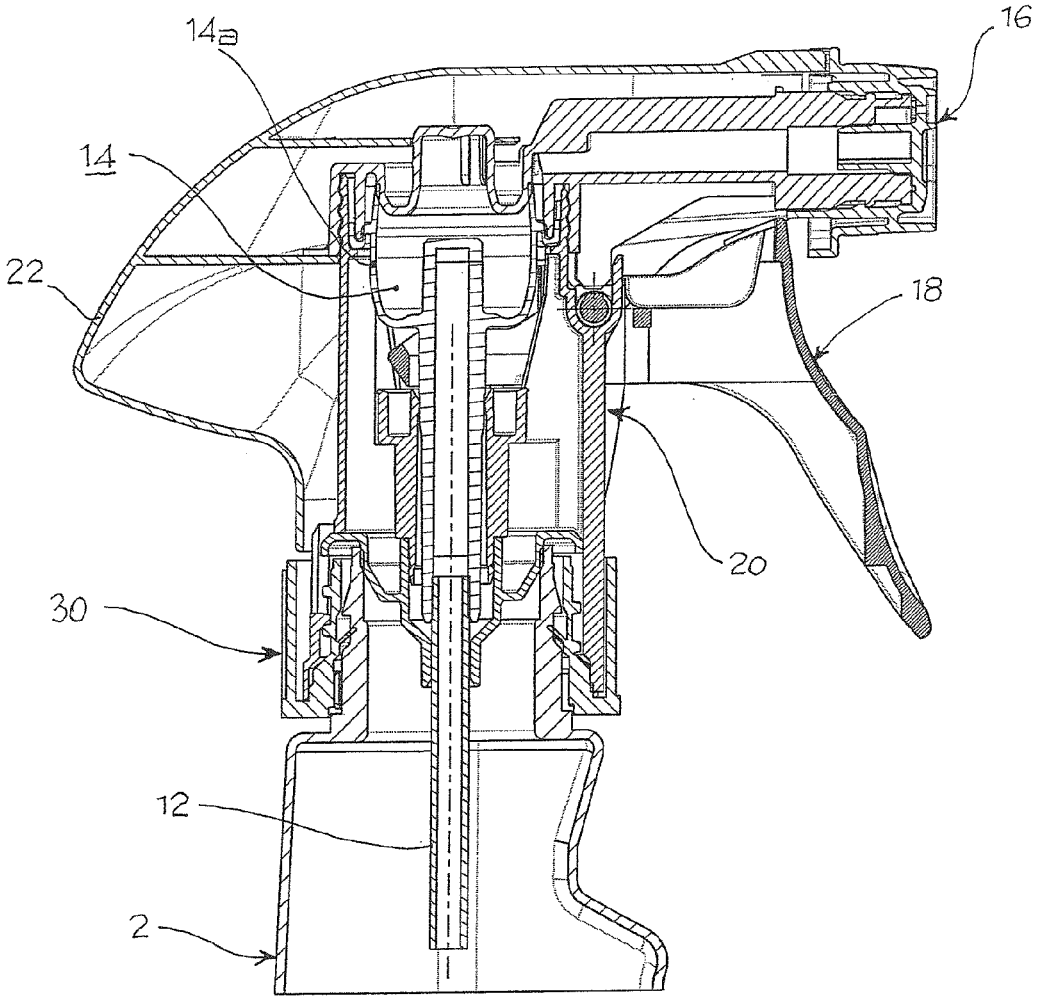
FIG. 2 shows a cross-section view of the dispenser device in FIG. 1, with the parts assembled.
Figure 3A:
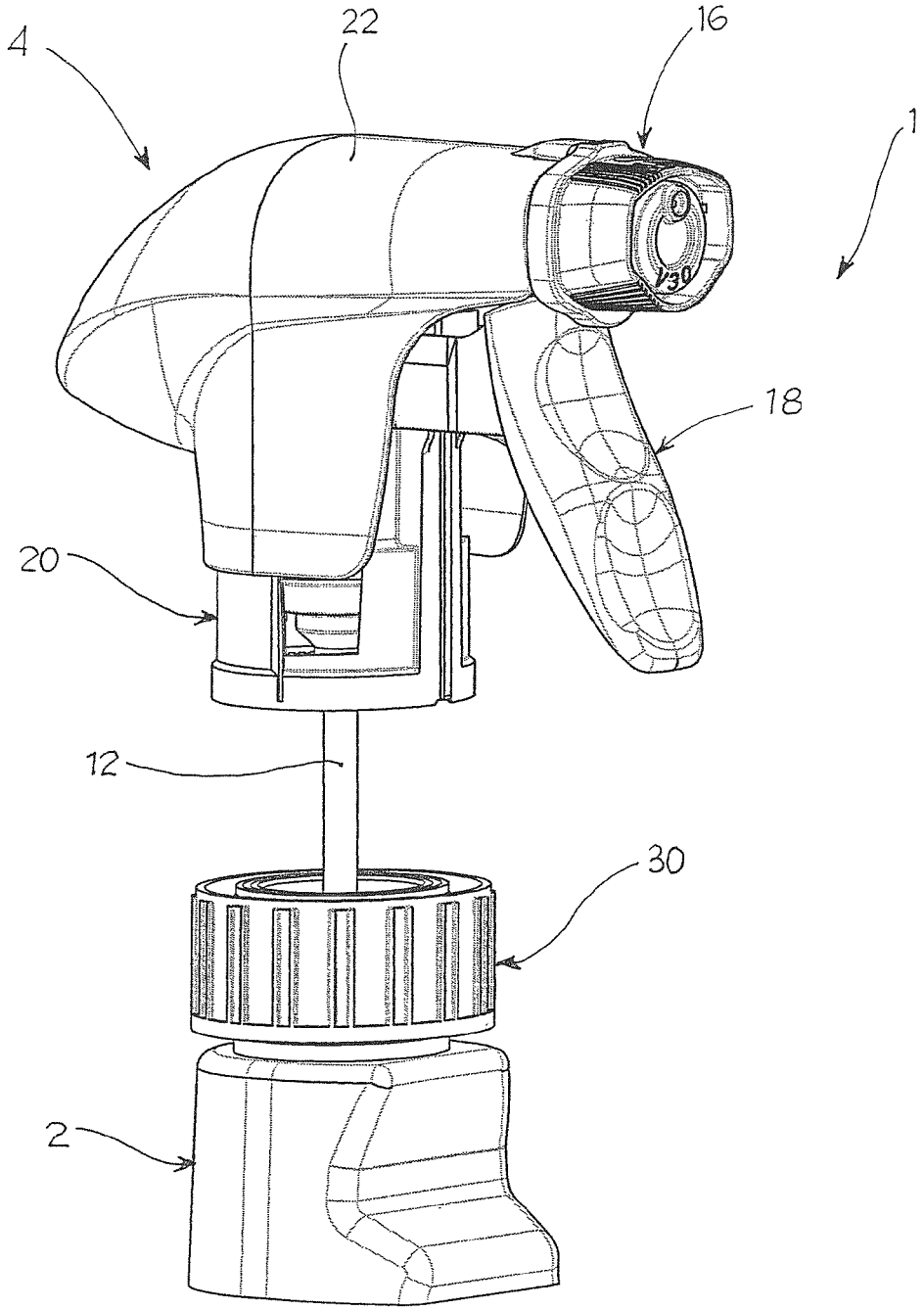
FIG. 3*a* shows a perspective view of the dispenser device in a configuration with the dispenser head detached and the intermediate body attached to the container.
Figure 3B:
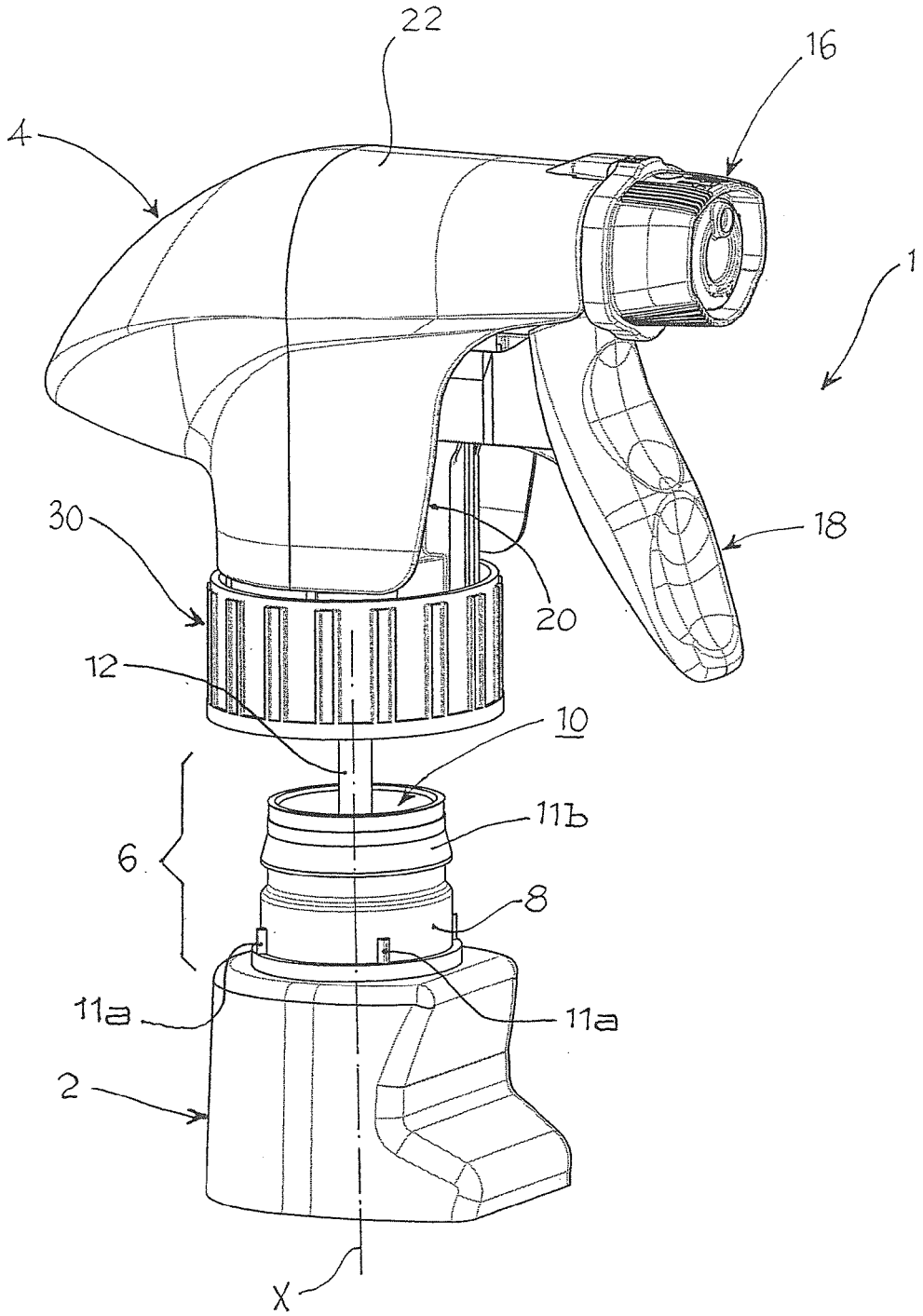
FIG. 3*b* shows a perspective view of the dispenser device in a configuration with the dispenser head and intermediate body detached from the container.
Figure 4:
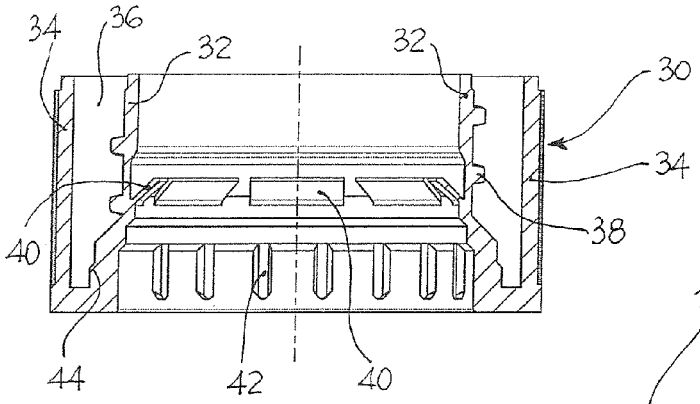
FIG. 4 shows a cross section view of an intermediate body of the closure system.
Figure 6C:
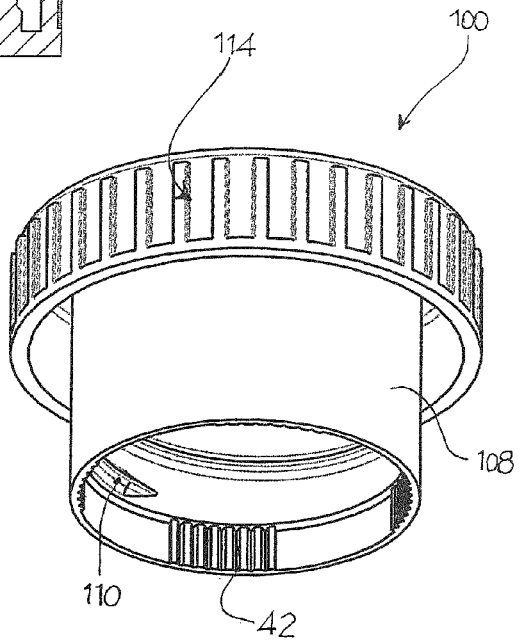
FIGS. 6*a*, 6*b* and 6*c*, 7*a* and 7*b*, 8*a* and 8*b* respectively show views of a neck and cap joined to it, fitted with the closure system according to the present invention.
Figure 5:
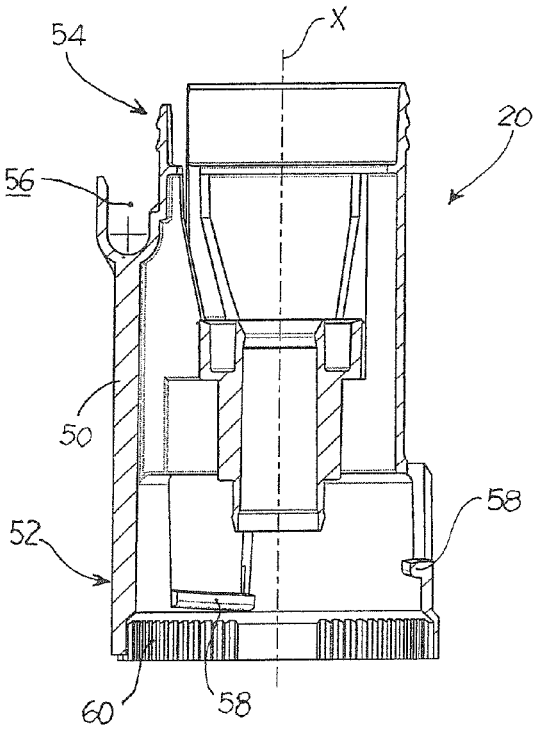
FIG. 5 shows a cross-section view of a frame of the closure system.
Figure 6A:
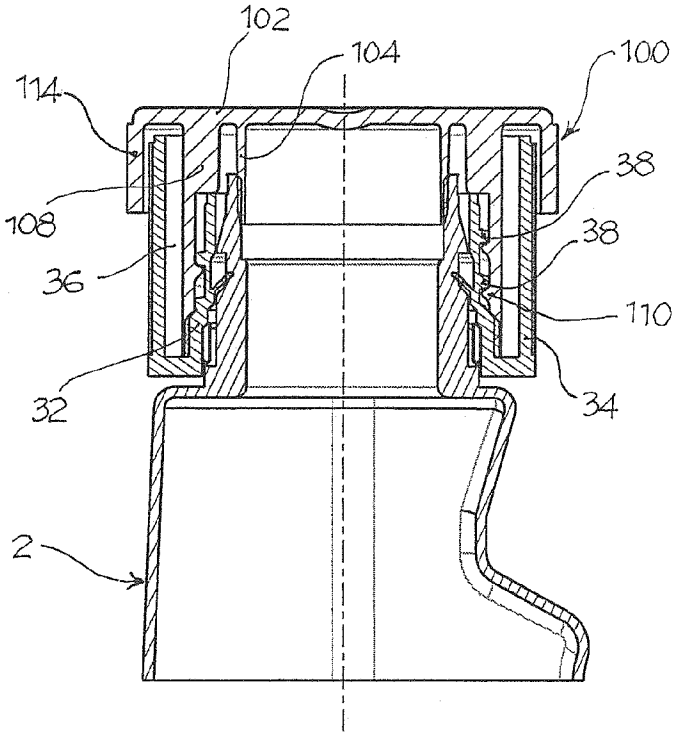
Figure 6B:
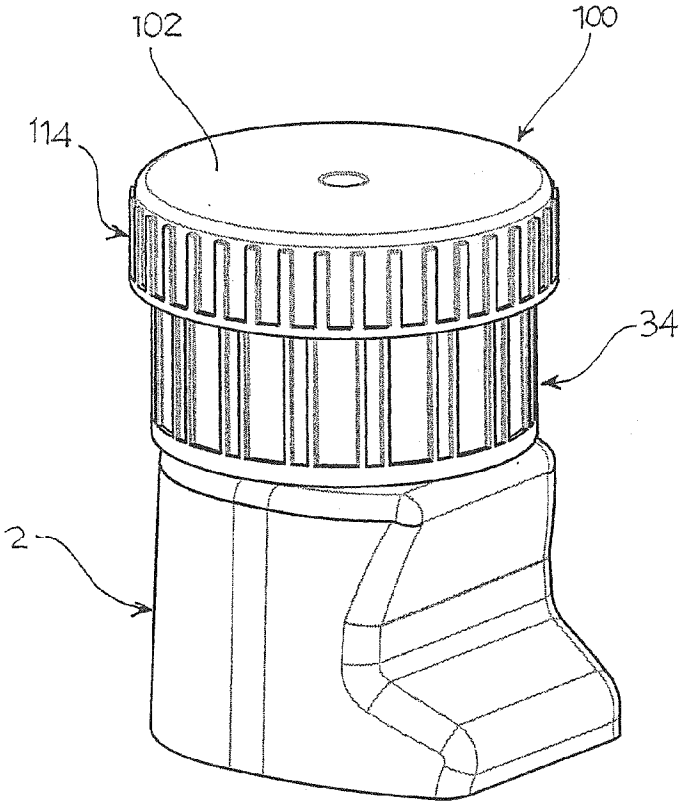

According to the present invention, a dispenser device 1, for example of the trigger type, comprises a container 2 to contain the liquid to be dispensed, and a dispenser head 4, for dispensing the liquid.

The container 2, for example in the form of a bottle, comprises a neck 6, comprising an annular neck wall 8 which extends around a longitudinal axis X and defines an aperture 10 for access to the inside of the container.

Preferably, the neck 6 comprises a neck notching, comprising at least one neck notch 11, protruding externally from the neck wall 8. For example the neck notching is composed of four neck notches 11*a*, equally spaced angularly.

Preferably, in addition, the neck 6 comprises an annular beading 11*b*, protruding externally from the neck wall 8. For example, the beading 11*b* is continuous and divergent towards the neck notches 11*a*.

The dispenser head 4 comprises, rather, a pumping mechanism for the aspiration of the liquid from the container and for dispensing towards the outside environment.

For example, the pumping mechanism comprises a suction duct 12, which extends inside the container, to take up the liquid contained in it, and a pumping chamber 14, defined by flexible walls 14*a*, with which the suction duct 12 communicates.

In the embodiment shown, in addition, the pumping mechanism comprises a nozzle 16, communicating with the pumping chamber 12.

The dispenser head preferably comprises a trigger 18, which can be rotated so as to interfere with the flexible walls 14*a* of the pumping chamber so as to deform them.

The deformation of the flexible walls leads to a reduction of the volume of the pumping chamber; so that the liquid contained in it is pushed towards the nozzle, from which it is dispensed outwardly.

Preferably, in addition, the pumping mechanism comprises valve mechanisms to consent/prevent aspiration of the liquid, consent/prevent dispensing of the liquid and consent/prevent aspiration of air.

The dispenser head comprises a frame 20, for example of a tubular shape, extending mainly along a longitudinal axis X.

Preferably, in addition, the dispenser head comprises a cover 22, supported by the body 20; the pumping mechanism is housed in the recess defined by the body 20 and by the cover 22.

Preferably, in addition, the trigger 18 is supported by the body 20, preferably hinged to it for rotation in the distal part of the neck of the container.

The releasable connection between the dispenser head and the container is made by a closure system.

The closure system comprises an intermediate body 30, inserted on the neck 6. The intermediate body 30 can be rotated on the neck 6 by performing a rotational movement, typically manually.

Preferably, the intermediate body 30 is annular and comprises an inner annular wall 32 and an outer annular wall 34, which extend along the longitudinal axis X. The walls 32, 34 are spaced in a radial direction, (that is perpendicular to the longitudinal axis X), so as to form a pocket 36.

The body of the dispenser head 4 is inserted in the pocket 36.

The inner wall 32, for example on the side facing the pocket 36, has a threaded body, preferably continuous.

In one embodiment variation, the threading is composed of a series of interrupted threaded sections. For example, the threaded body comprises three threaded sections of equal extension, angularly distanced at 120°.

The inner wall 32, on the other side, facing the neck of the container, also has at least one flexible tab 40.

In the embodiment shown, a number of tabs positioned circumferentially, are provided.

Preferably, the tab 40 lies on a geometric plane inclined in relation to the plane perpendicular to the longitudinal axis X; specifically, the tab is inclined in the opposite direction to the direction of insertion of the intermediate body 30 onto the neck 6 of the container 2, to invite coupling.

The tabs 40 of the intermediate body 30 and the beading 11*b* of the neck 6 form an example of means of coupling the intermediate body—neck which fix the intermediate body 30 to the neck 6, consenting at most a limited longitudinal shift, to prevent separation.

Preferably, the neck-body means of coupling are snap action.

In fact, inserting the intermediate body 30 onto the neck 6, the flexible tabs 40 are deformed, opening on contact with the beading 11*b*, which is divergent in the direction of insertion of the intermediate body onto the neck, until they pass over it. Once past the beading the tabs close again automatically.

In the attempt to separate the intermediate body 30 from the neck 6, pulling the intermediate body in the direction opposite to that of insertion, the tabs 40 push against the beading 11*b* and prevent unscrewing of the intermediate body from the neck.

According to a preferred embodiment, the intermediate body 30 comprises a first notching of the body, formed of at least one body notch 42. The first body notching is made on the inner wall 32, on the side facing the neck 6 of the container 2.

With reference to the direction of insertion of the intermediate body 30 onto the neck 6, the first body notch is upstream of the tabs 40.

The first body notching and the neck notching form an example of body-neck means of interference, able to interfere with the free rotation of the intermediate body 30 on the neck 6 of the container 2.

The body-neck interference mechanisms can be engaged to each other to be attached in rotation and yielding so as to move against each other by means of action equal to or greater than the predefined action of rotation.

In fact, by grasping the intermediate body and trying to rotate it on the neck using a mechanical torque creating a weaker action than the predefined rotational action, the body notches 42 and the neck notches 11*a* interfere with each other and prevent rotation. While if the action exerted is greater than the predefined rotation action, a distortion occurs, for example attributable to the body and/or neck notches which override each other, creating a relative rotation between the intermediate body and the neck of the container.

Preferably, in addition, the intermediate body 30 comprises a second notching, comprising a number of notches 44. For example, the second notching protrudes from the inner wall 32, on the bottom of this.

The frame 20 of the dispenser head comprises an annular frame wall 50, which extends around the longitudinal axis X, between an extremity 52 proximal to the neck 6 and an extremity distal 54 to this.

Preferably, at the distal extremity 54, the frame 20 comprises a seat 56, for accommodating a portion of trigger 18, so as to form a hinging.

Preferably, in addition, the frame 20 comprises a frame threading 58, for example on the frame wall 50, internally.

For example, the frame threading 58 is formed by a succession of interrupted threaded sections. For example, the frame threading comprises three threaded sections of equal extension, angularly spaced at 120°.

The frame threading 58 is suitable for screwing onto the body threading 38.

The frame threading 58 and the body threading 38 form releasable means of coupling the frame-body. The frame-body means of coupling require a release action greater than the rotational action for release.

Preferably, in addition, the frame 20 comprises a frame notching, comprising at least one frame notch 60.

For example, the frame notching is formed of a number of frame notches 60 protruding internally from the frame wall 50, next to the proximal extremity 52.

The second body notching and the frame notching form an example of frame-body means of interference, able to interfere with the rotation of the frame on the intermediate body. The frame-body interference mechanisms can be engaged to each other to be attached in rotation and are yielding so as to move against each other by means of action equal to or greater than the release action.

During normal use of the dispenser device 1, a user, in a first hypothesis, grasps the dispenser head, for example, grasping the cover 22, and turns it.

If the direction of rotation of the head is in the screw-on direction, the frame will not tend to unscrew from the intermediate body and transmits the action to the intermediate body.

If the action exerted is slight, the body-neck interference mechanism will not even allow rotation of the intermediate body in relation to the neck. No separation of the frame from the intermediate body will arise in any case.

If the action exerted is considerable the interference mechanism will not resist such action and the intermediate body is dragged in rotation in relation to the neck. In this case too however no separation of the frame and the intermediate body will occur.

If the direction in which the user operates on the dispenser head is to unscrew the frame from the intermediate body, the frame would tend to unscrew from the intermediate body, separating itself, but until the intermediate body is blocked manually, this does not occur.

In fact if the action exerted to unscrew is slight, the frame-body interference mechanism is effective and blocks rotation of the intermediate body in relation to the neck. However the unscrewing action is too slight to permit unscrewing.

If the action exerted in the unscrewing direction is considerable the frame-body interference mechanism will not resist such action and the intermediate body is dragged in rotation in relation to the neck. In this case too however no separation of the frame and the intermediate body will occur.

In other words, between the frame and the intermediate body there is a sort of clutch-effect.

If however the intermediate body is blocked in rotation, for example held by the user's other hand, and the direction of the action of the user is in the unscrewing direction, the frame is separated from the intermediate body by unscrewing.

In the same way as the frame of the dispenser head, a cap 100 can be coupled to the neck 6 of the container 2 (figures from 6*a* to 8*b*).

The cap 100 comprises a base 102 able to be placed over the aperture 10 of the container.

Figure 7A:
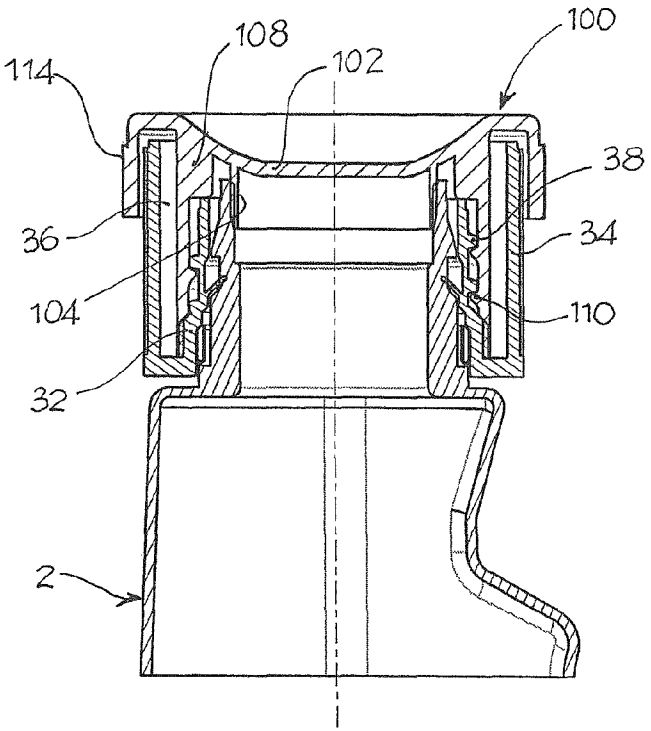
Figure 7B:
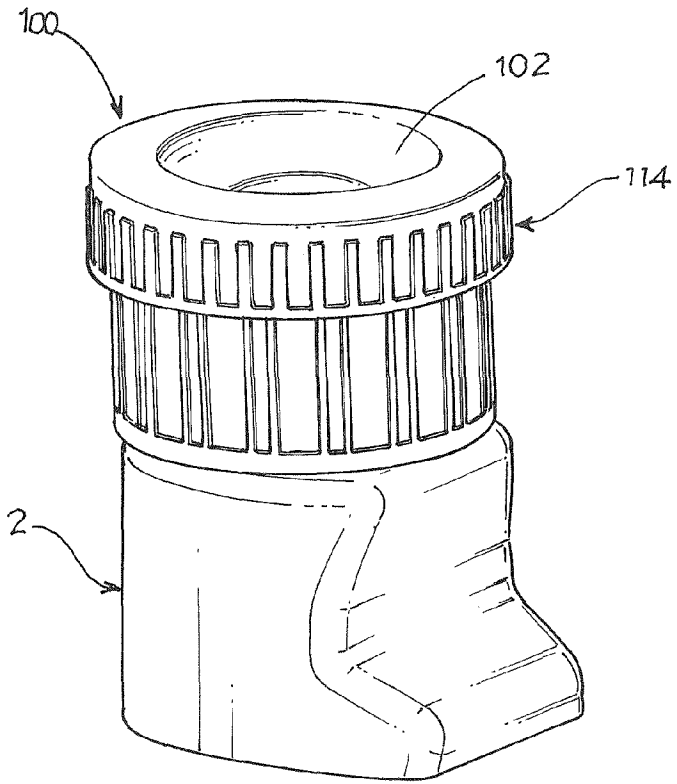
Figure 8A:
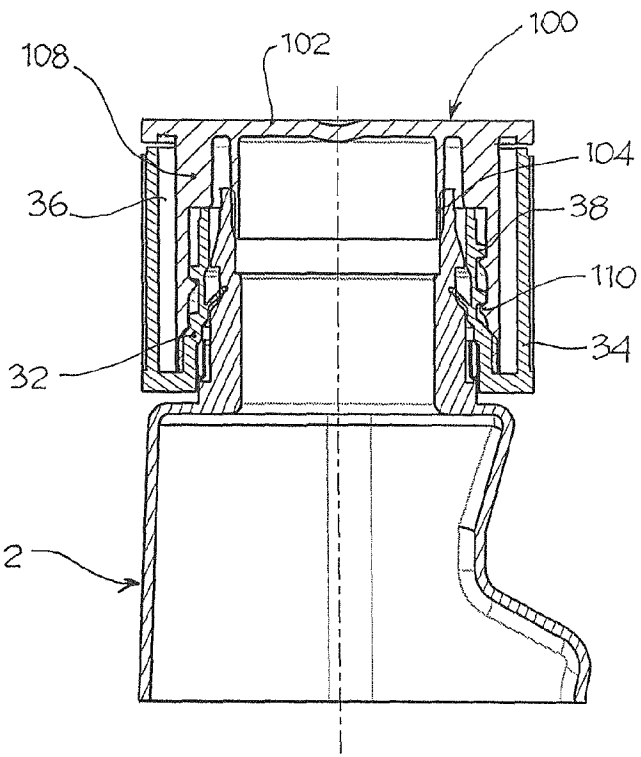
Figure 8B:
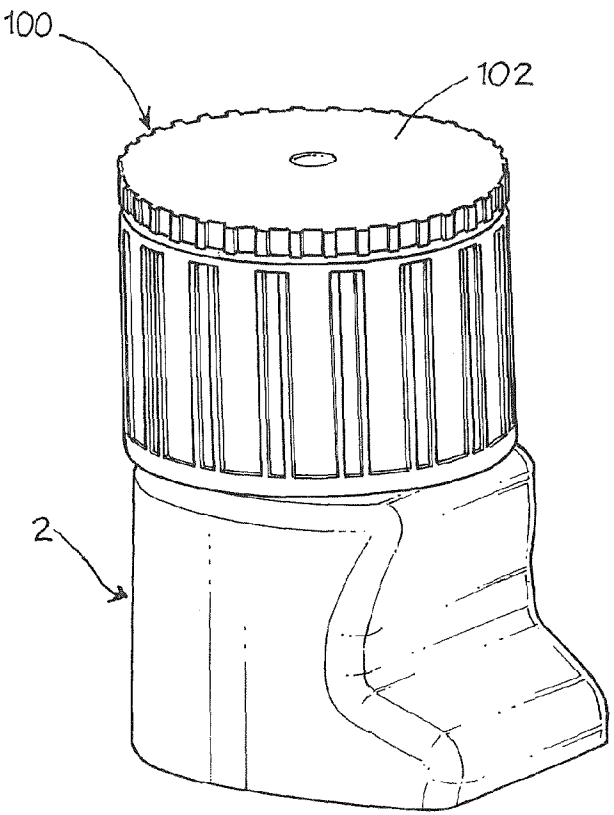

In one other variation, the base 102 is lower in the central part so as to be closer to the rim of the aperture 10 (FIGS. 7*a* and 7*b*).

According to a further variation, the cap 100 comprises a sealing mechanism so as to form a seal with the neck 6 of the container.

For example, the sealing mechanism comprises an annular sealing wall 104, protruding from the base 102 along the longitudinal axis X and in contact with the inner side of the neck 6, to form an inner seal.

In addition, the cap 100 comprises an annular attachment wall 108, protruding from the base 102 along the longitudinal axis X, able to engage with the intermediate body 30 of the closure system.

For example, the attachment wall 108 is positioned externally radial to the sealing wall 102.

The attachment wall 108 is inserted into the pocket 36 of the intermediate body 30.

The cap 100 comprises, in addition, a cap threading 110, for example on the inner side of the attachment wall; the cap threading 110 is able to engage with the body threading 38 of the intermediate body 30.

The cap threading 110 and the body threading form an example of releasable means of cap-body coupling and require a release action greater than the rotational action to enable release.

According to the examples, the cap 100 comprises an annular skirt 114, protruding along the longitudinal axis X, outside the attachment wall 108.

Preferably, the skirt 114 has such an extension as to overlay longitudinally the outer annular wall 34 of the intermediate body 30.

The functioning of the cap-container system is analogous to the functioning of the dispenser head-container system.

Innovatively, the closure system according to the present invention creates a secure system and at the same time enables replacement of the container or topping up of the liquid contained in it.

Advantageously in addition the security system makes it possible to prevent accidental unscrewing of the frame from the intermediate body, for example due to transport vibrations, thanks to the frame-body interference mechanism.

It is clear that a person skilled in the art, in order to satisfy contingent requirements, may make modifications to the closure system described above.

For example, the releasable means of connection between the frame and the intermediate body, in one embodiment variation, are of the bayonet type.

In a further embodiment variation, the trigger is translatable for dispensing.

All these variations are to be considered as falling within the scope of protection defined by the following claims.

The invention claimed is:

1. A closure system for a dispenser, comprising:

a neck of a container, comprising an annular neck wall extending around a longitudinal axis and defining an aperture for access to an inside of the container;

an intermediate body, inserted on the neck;

a body-neck coupling which fixes the intermediate body to the neck, allowing at most a limited, longitudinal movement, to prevent the intermediate body and the neck from separating;

a frame of a dispenser head, which can be activated for aspiration of liquid from the container and dispensing the liquid to an outside environment;

a releasable frame-body coupling, said frame being connected to the intermediate body by means of said frame-body coupling;

wherein the intermediate body can be rotated on the neck by exerting a rotational action and the frame is detachably connected to the intermediate body, said frame-body coupling requiring for release a release action greater than the rotational action; and a body-neck interference mechanism which can interfere with the free rotation of the intermediate body on the neck of the container, wherein the body-neck interference mechanism comprises a body notching and a neck notching, engageable to each other so as to be fixed in rotation and yielding to move against each other by means of an action equal to or greater than the rotational action.

2. A system according to claim 1, comprising a frame-body interference mechanism able to interfere with the rotation of the frame on the intermediate body.

3. A system according to claim 2, wherein the frame-body interference mechanism comprises a frame notching and a further body notching, engageable to each other so as to be fixed in rotation and yielding to move against each other by means of an action equal to or greater than the release action.

4. A system according to claim 1, wherein the body-neck coupling is snap-activated.

5. A system according to claim 4, wherein the body-neck coupling comprises at least one flexible tab protruding from the intermediate body and a beading protruding from the neck, able to form a longitudinal bond for snap insertion of the intermediate body onto the neck.

6. A system according to claim 5, wherein the intermediate body comprises an inner annular wall to engage with the neck of the container and with the frame of the dispenser head.

7. A system according to claim 6, wherein the intermediate body comprises an outer annular wall, said outer annular wall and said inner annular wall forming a pocket for insertion of the frame of the dispenser head.

8. A system according to claim 7, wherein a threading is formed on the inner annular wall of the intermediate body on the side facing the pocket, and said at least one flexible tab is formed on the inner wall of the intermediate body, on the side opposite that of the threading.

9. A system according to claim 1, wherein the frame-body coupling comprises a frame threading and a body threading.

10. A dispenser device comprising:

a container for containing a liquid to dispense, said container having a neck comprising an annular neck wall extending around a longitudinal axis and defining an aperture for access to an inside of the container;

a dispenser head comprising:

a) a pumping mechanism for aspiration of the liquid from the container and dispensing towards an outside environment;

b) a trigger, to activate the pumping mechanism; and c) a cover, supported by the frame;

an intermediate body, inserted on the neck;

a body-neck coupling which fixes the intermediate body to the neck, allowing at most a limited, longitudinal movement, to prevent the intermediate body and the neck from separating;

a frame of a dispenser head, which can be activated for aspiration of liquid from the container and dispensing the liquid to the outside environment;

a releasable frame-body coupling, said frame being connected to the intermediate body by means of said frame-body coupling;

wherein the intermediate body can be rotated on the neck by exerting a rotational action and the frame is detachably connected to the intermediate body, said frame-body coupling requiring for release a release action greater than the rotational action; and a body-neck interference mechanism which can interfere with the free rotation of the intermediate body on the neck of the container wherein the pumping mechanism is housed in the a recess defined by the frame and the cover.

11. A device according to claim 10, wherein the trigger is supported by the frame.

* * * * *